US010294573B2

(12) United States Patent
Parkos, Jr. et al.

(10) Patent No.: US 10,294,573 B2
(45) Date of Patent: May 21, 2019

(54) ELECTROFORMED SHEATH

(71) Applicant: United Technologies Corporation, Hartford, CT (US)

(72) Inventors: Joseph Parkos, Jr., East Haddam, CT (US); James O. Hansen, Glastonbury, CT (US); Christopher J. Hertel, Wethersfield, CT (US); Andrew J. Murphy, Old Saybrook, CT (US); Ashley P. Phillips, Rocky Hill, CT (US); Jay Thomas Abraham, Stamford, CT (US)

(73) Assignee: United Technologies Corporation, Farmington, CT (US)

( * ) Notice: Subject to any disclaimer, the term of this patent is extended or adjusted under 35 U.S.C. 154(b) by 0 days.

(21) Appl. No.: 14/644,954

(22) Filed: Mar. 11, 2015

(65) Prior Publication Data

US 2015/0184306 A1 Jul. 2, 2015

Related U.S. Application Data

(62) Division of application No. 13/366,923, filed on Feb. 6, 2012.

(51) Int. Cl.
*F01D 5/14* (2006.01)
*C25D 1/00* (2006.01)
(Continued)

(52) U.S. Cl.
CPC ..... *C25D 1/00* (2013.01); *C25D 1/02* (2013.01); *F01D 5/147* (2013.01); *F04D 29/324* (2013.01);
(Continued)

(58) Field of Classification Search
CPC ..... C25D 1/16; Y10T 29/49336; Y10T 29/49337; B23P 2700/13; B23P 15/02; B23P 15/04
See application file for complete search history.

(56) References Cited

U.S. PATENT DOCUMENTS 3,028,292 A 4/1962 Hinds
3,464,898 A 9/1969 Norris
(Continued)

OTHER PUBLICATIONS

"Electroforming", https://web.archive.org/web/20111127023513/http://en.wikipedia.org/wiki/Electroforming published on Nov 27, 2011.

(Continued)

*Primary Examiner* — Jason L Vaughan
*Assistant Examiner* — Amanda Kreiling
(74) *Attorney, Agent, or Firm* — O'Shea Getz P.C.

(57) ABSTRACT

An electroformed sheath for protecting an airfoil includes a sheath body and a mandrel insert is provided. The sheath body includes a leading edge. The sheath body includes a pressure side wall and an opposed suction side wall, which side walls meet at the leading edge and extend away from the leading edge to define a cavity between the side walls. The sheath body includes a head section between the leading edge and the cavity. The mandrel insert is positioned between the pressure side and suction side walls, and includes a generally wedge-shaped geometry. A method for protecting an airfoil includes: 1) securing a mandrel insert to a mandrel; 2) electroplating a sheath body onto the mandrel and the mandrel insert; 3) removing the mandrel from the sheath body so that a sheath cavity is defined within the sheath body; and 4) securing the airfoil within the sheath cavity.

4 Claims, 4 Drawing Sheets

(51) Int. Cl.
*C25D 1/02* (2006.01)
*F04D 29/32* (2006.01)

(52) U.S. Cl.
CPC ..... *F05D 2230/30* (2013.01); *F05D 2230/90* (2013.01); *F05D 2240/303* (2013.01); *F05D 2300/603* (2013.01)

(56) References Cited

U.S. PATENT DOCUMENTS 3,554,875 A 1/1971 Mackinney
3,762,835 A 10/1973 Carlson et al.
3,892,612 A 7/1975 Carlson et al.
3,923,421 A * 12/1975 Carter ..... B64C 27/006 244/1 A
4,275,994 A 6/1981 Underhill, Jr.
4,648,921 A 3/1987 Nutter
5,306,120 A 4/1994 Hammer et al.
5,449,273 A 9/1995 Hertel et al.
5,486,096 A 1/1996 Hertel et al.
5,674,370 A * 10/1997 DuPree ..... C25D 1/00 205/114
5,881,972 A 3/1999 Smith et al.
5,908,285 A * 6/1999 Graff ..... C25D 1/10 205/67
6,447,254 B1 9/2002 Holowczak et al.
7,510,778 B2 3/2009 Bernard et al.
7,805,839 B2 10/2010 Cammer
2006/0018760 A1 1/2006 Bruce et al.
2008/0124512 A1 5/2008 Steibel et al.
2010/0014964 A1 1/2010 Smith et al.
2010/0232974 A1 9/2010 De Moura et al.
2011/0097213 A1 * 4/2011 Peretti ..... B23P 15/04 416/241 A
2011/0211967 A1 9/2011 Deal et al.
2012/0163981 A1 6/2012 Hong

OTHER PUBLICATIONS

Written opinion for SG11201404663R dated Oct. 19, 2016.

* cited by examiner

ELECTROFORMED SHEATH

CROSS-REFERENCE TO RELATED APPLICATION(S)

This application is a divisional of U.S. patent application Ser. No. 13/366,923 filed Feb. 6, 2012, which is hereby incorporated by reference.

BACKGROUND OF THE INVENTION

1. Technical Field

The present invention relates to electroformed parts in general, and to an electroformed sheath for protecting a leading edge of an airfoil of a gas turbine engine in particular.

2. Background Information

Historically, airfoils of gas turbine engines have been designed to provide adequate mechanical strength and durability to protect themselves from erosion and foreign object damage, and especially from damage as a result of leading edge impact with birds, ice, stones, sand, rain and other debris. Protective sheaths are often used to protect the leading edge.

It is known to manufacture protective sheaths using electroforming techniques, as described, e.g., in U.S. Pat. No. 5,908,285, which is incorporated herein by reference. Electroforming techniques work reasonably well, but can also have constraints that make it difficult to manufacture sheaths having certain characteristics (e.g., certain geometries, dimensions, etc.). It is known to use a mandrel insert to overcome constraints of electroforming techniques. Still, there remains a need in the art for electroformed sheaths having certain characteristics. There is also a need in the art for methods for protecting airfoils of a gas turbine engine using such electroformed sheaths.

SUMMARY OF THE INVENTION

According to one aspect of the present invention, an electroformed sheath for protecting an airfoil of a gas turbine engine is provided. The electroformed sheath includes a sheath body and a mandrel insert. The sheath body includes a leading edge. The sheath body includes a pressure side wall and an opposed suction side wall, which side walls meet at the leading edge and extend away from the leading edge to define a cavity between the side walls. The sheath body includes a head section between the leading edge and the cavity. The mandrel insert is positioned between the pressure side wall and suction side wall. The mandrel insert includes a cross-sectional geometry that is generally wedge-shaped.

According to another aspect of the present invention, a method for protecting an airfoil of a gas turbine engine is provided. The method includes the steps of: (1) securing an electrically conductive mandrel insert to a mandrel, wherein the mandrel insert includes a cross-sectional geometry that is generally wedge-shaped; (2) electroplating, in an electroplate bath, a sheath body onto the mandrel and the mandrel insert; (3) removing the mandrel from the sheath body so that a sheath cavity is defined within the sheath body by the position occupied by the mandrel to form an electroformed sheath; and (4) securing the airfoil within the sheath cavity so that the electroformed sheath protects the airfoil.

According to another aspect of the present invention, an airfoil of a gas turbine engine is provided. The airfoil includes a sheath body and a mandrel insert. The sheath body includes a leading edge. The sheath body includes a pressure side wall and an opposed suction side wall of the sheath body, which side walls meet at the leading edge and extend away from the leading edge to define a cavity between the side walls. The sheath body includes a head section between the leading edge and the cavity. The mandrel insert is positioned between the pressure side wall and suction side wall. The airfoil fills the cavity in affixing the electroformed sheath to the airfoil so that the leading edge, the head section and the mandrel insert protect the airfoil. The mandrel insert includes a cross-sectional geometry that is generally wedge-shaped.

In a further embodiment of any of the foregoing embodiments, the head section is defined by a length and a width, and a ratio of the length to the width is related to the radius.

In a further embodiment of any of the foregoing embodiments, the mandrel insert is defined by a length and a width, and the width of the mandrel insert is greater than a thickness of the sheath body pressure side wall or a thickness of the sheath body suction side wall.

In a further embodiment of any of the foregoing embodiments, the mandrel insert is made of a non-metallic composite.

In a further embodiment of any of the foregoing embodiments, the non-metallic composite includes one or more of the following materials: fiber-reinforced thermoset composite, fiber-reinforced thermoplastic composite, continuous or discontinuous carbon fiber or fiberglass fiber, bismaleimide, polyimide families, or thermoplastic matrix resins.

In a further embodiment of any of the foregoing embodiments, the mandrel insert is a honeycomb-like structure.

In a further embodiment of any of the foregoing embodiments, the mandrel insert is coated with a metallic material.

In a further embodiment of any of the foregoing embodiments, the metallic material includes one or more of the following materials: graphite, aluminum, silver or palladium.

In a further embodiment of any of the foregoing embodiments, a dimension of the mandrel insert is selected in order to achieve a dimension of the sheath body.

In a further embodiment of any of the foregoing embodiments, a geometry of the mandrel insert is selected in order to achieve a geometry of the sheath body.

In a further embodiment of any of the foregoing embodiments, the sheath body is made of a material that is capable of being electroplated.

In a further embodiment of any of the foregoing embodiments, the sheath body is made of one or more of the following materials: nickel, nickel-cobalt alloy.

In a further embodiment of any of the foregoing embodiments, the airfoil is made of a first material and the mandrel insert is made of a second material, and the first material is less durable than the second material.

In a further embodiment of any of the foregoing embodiments, the airfoil is one of the following: a fan blade, a turbine blade, or a compressor blade.

The foregoing features and advantages and the operation of the invention will become more apparent in light of the following description of the best mode for carrying out the invention and the accompanying drawings.

DETAILED DESCRIPTION OF THE INVENTION

Figure 1:
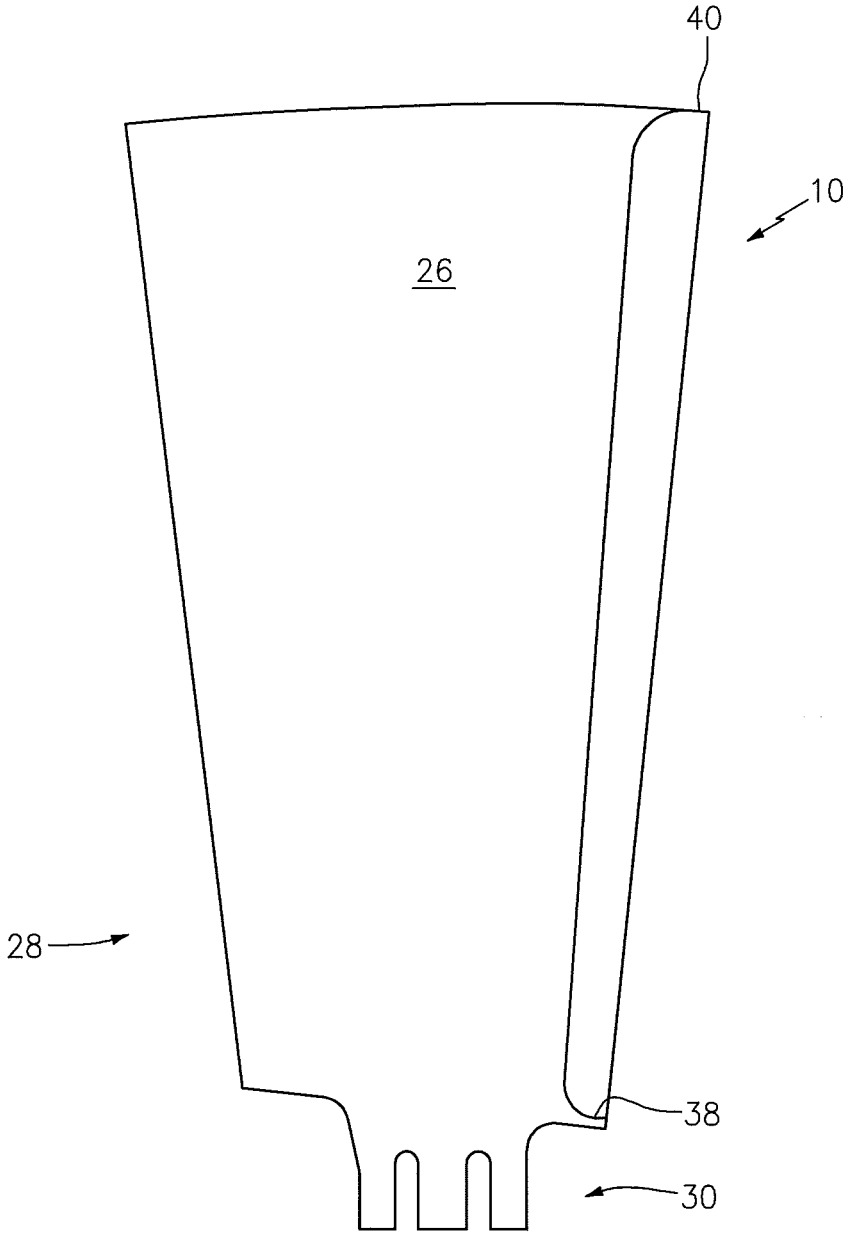
FIG. 1 is a schematic diagram depicting an exemplary embodiment of a fan blade of a modern gas turbine engine employing an electroformed sheath constructed in accordance with the present invention.
Figure 2:
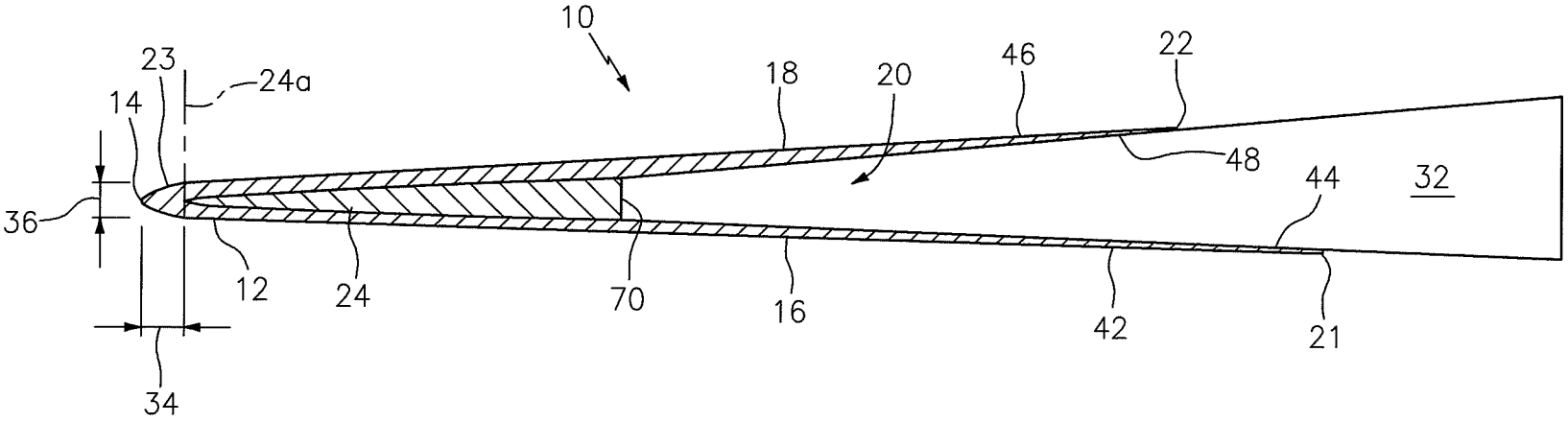
FIG. 2 is a cross-sectional schematic diagram depicting an exemplary embodiment of an electroformed sheath constructed in accordance with the present invention, showing the sheath on a mandrel.
Figure 3:
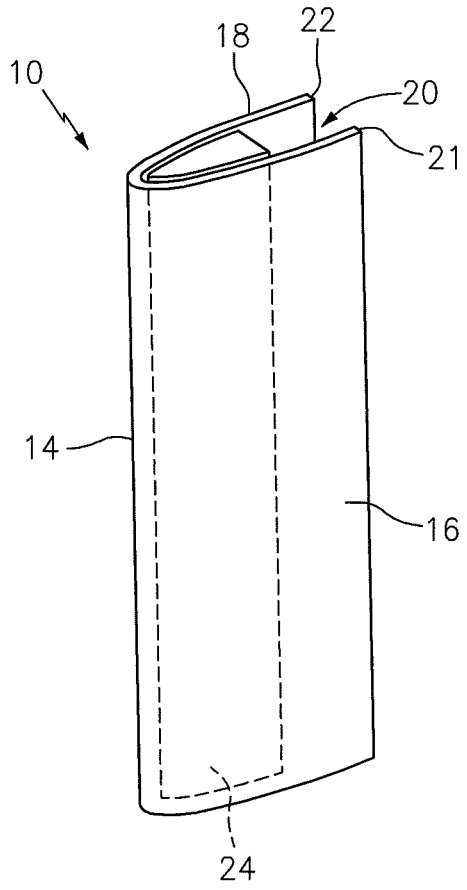
FIG. 3 is a schematic diagram depicting an exemplary embodiment of an electroformed sheath constructed in accordance with the present invention, showing the sheath removed from a mandrel.

Referring to the drawings in detail, an electroformed sheath of the present invention is shown in FIGS. 1-3 and generally designated by the reference numeral 10. As best seen in FIG. 2, the electroformed sheath 10 includes a sheath body 12 having a leading edge 14, a pressure side wall 16 and an opposed suction side wall 18. The side walls 16, 18 meet at the leading edge 14 and extend away from the leading edge 14 to define a sheath cavity 20. The side walls 16, 18 end at a pressure side wall trailing edge 21 and a suction side wall trailing edge 22, respectively. The sheath body 12 also includes a head section 23 extending between the leading edge 14 and the cavity 20. The electroformed sheath 10 also includes a mandrel insert 24 positioned between the pressure and suction side walls 16, 18 of the sheath body 12. FIG. 1 shows the electroformed sheath 10 affixed to an airfoil 26 of a fan blade 28. The fan blade 28 includes a root 30 that is configured to engage a gas turbine engine fan hub (not shown) in a manner that secures the fan blade 28 to the hub. The present invention is not limited to fan blade applications; the sheath 10 may alternatively be affixed to other gas turbine rotary components; e.g., turbine blades, compressor blades, etc. FIG. 2 shows the electroformed sheath 10 during manufacturing, affixed to a mandrel 32. FIG. 3 shows the electroformed sheath 10 after being removed from the mandrel 32, but before being affixed to the airfoil 26 of fan blade 28, as discussed below.

Referring to FIG. 2, the head section 23 of the sheath body 12 has a cross-sectional geometry that is generally wedge-shaped. The head section 23 is defined by a length 34, a width 36, and a height. The length 34 of the head section 23 is defined as the distance along an axis equidistant between the pressure and suction side walls 16, 18 extending from the leading edge 14 to the cavity 20. The width 36 of the head section 23 is defined as a distance extending between the pressure and suction side walls 16, 18, as measured along an axis 24*a* at the tip of the mandrel insert 24. The height is defined as a distance extending between a sheath inner edge 38 and a sheath outer edge 40, as shown in FIG. 1. The ratio of the length 34 to the width 36 (hereinafter "the length-to-width ratio") may vary. The length-to-width ratio is related to the "sharpness" of the leading edge 14. The term "sharp", and variations thereof, are used herein to describe the relative size of a radius defined by the leading edge 14; e.g., a leading edge that defines a relatively small radius may be described as being "sharp". It is noted that although the leading edge 14 is described herein as defining a radius, the leading edge 14 need not be circular; e.g., the leading edge 14 may be arcuate. The higher the length-to-width ratio, the sharper the leading 14 will be; e.g., a head section having a length-to-width ratio of 10:1 will typically be sharper than a head section having a length-to-width ratio of 1:1. The characteristics of the head section 23 (e.g., geometry and dimensions) may be selected so as to reduce overall mass (and thus overall weight) of the sheath body 12.

Referring still to FIGS. 1 and 2, the pressure side wall 16 has thicknesses defined as distances measured from an exterior surface 42 of pressure side wall 16 to an opposed interior surface 44 of the pressure side wall 16. Similarly, the suction side wall 18 has thicknesses defined as distances measured from an exterior surface 46 of suction side wall 18 to an opposed interior surface 48 of the suction side wall 18. The thicknesses of the pressure and suction side walls 16, 18 may vary along their lengths; e.g., a thickness of the pressure side wall 16 at a portion adjacent the head section 23 may be greater than a thickness of the pressure side wall 16 at the pressure side wall trailing edge 21. The thicknesses of the pressure and suction side walls 16, 18 may be relatively small so as to reduce overall mass (and thus overall weight) of the sheath body 12. The pressure and suction side walls 16, 18 each have a length defined by a distance extending along the axis described above (i.e., the axis equidistant between the pressure and suction side walls 16, 18 extending from the leading edge 14 to the cavity 20). In FIG. 2, the length of the pressure side wall 16 of the sheath body 12 is greater than the length of the suction side wall 18. In alternative embodiments, the length of the suction side wall 18 of the sheath body 12 may be greater than or equal to the length of the pressure side wall 16.

The sheath body 12 is made of a material, or a combination of materials, capable of being electroplated to the mandrel insert 24 and mandrel 32. The sheath body 12 is typically made of a material, or a combination of materials, that provides suitable impact resistance and durability. Nickel is a favored material because it is capable of being electroplated, it has a relatively low-density, and it provides suitable impact resistance and durability. Other acceptable materials for the sheath body 12 include nickel-cobalt alloys. The sheath body 12 is not limited to use with any particular material.

Figure 4:
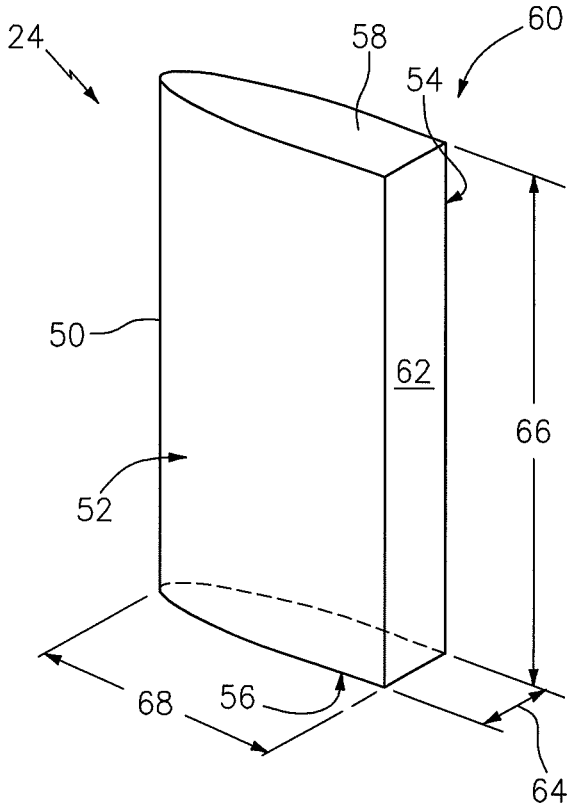
FIG. 4 is a schematic diagram depicting an exemplary embodiment of a mandrel insert used with the electroformed sheath of the present invention.

Referring to FIG. 4, the mandrel insert 24 includes a leading edge 50; a pressure side 52 and a suction side 54, both of which extend from the leading edge 50; opposing ends 56, 58; and an aft portion 60 that includes a generally planar datum surface 62 that interconnects the sides 52, 54 and ends 56, 58 of the mandrel insert 24. The opposing ends 56, 58 have a geometry that is generally wedge-shaped. The datum surface 62 is defined by a width 64 and a height 66. The datum surface 62 is not limited to any particular width 64. Notably, the width 64 of the datum surface 62 may be greater than the thicknesses of the pressure and suction sides 16, 18 of the sheath body 12. The mandrel insert 24 may extend along the entire height of the sheath body 12; accordingly, the height 66 of the datum surface 62 may be approximately equal to the height of the head section 23 of the sheath body 12. The length 68 of the mandrel insert 24 is defined as the length along an axis equidistant between the sides 52, 54 extending from the leading edge 50 to the datum surface 62. Because the sheath body 12 is electroplated about the mandrel insert 24 (e.g., using the manufacturing processes discussed below), the characteristics of the mandrel insert 24 (e.g., geometry, width 64, height 66, length 68, etc.) correspond to the characteristics of the sheath body 12 (e.g., geometry, length 34, width 34, length-to-width ratio, "sharpness" of the leading edge 14, etc.). Accordingly, one or more characteristics of the mandrel insert 24 may be selected in order to achieve one or more desired characteristics of the sheath body 12.

The mandrel insert 24 may be made from a material with greater mechanical strength and durability than the material of the sheath body 12. The material of the mandrel insert 24 may be selected so that the mandrel insert 24 provides acceptable mechanical strength and durability while also reducing the overall weight of the electroformed sheath 10. In some embodiments, the mandrel insert 24 is made from a non-metallic composite material (e.g., a fiber-reinforced thermoset or thermoplastic composite). The non-metallic composite material may include continuous or discontinuous carbon fiber or fiberglass fiber for reinforcement. The non-metallic composite material may include bismaleimide, or polyimide families, or thermoplastic matrix resins such as polyetherimide or polyether ether ketone. Carbon/epoxy is an acceptable material because it has a relatively low-density material, and has acceptable mechanical strength and durability. In embodiments in which the mandrel insert 24 is fabricated from a non-metallic composite material, the mandrel insert 24 may be coated with a material that is sufficiently conductive to enable electroplate formation of the sheath body 12 about the mandrel insert 24. The coating material may include graphite, aluminum, silver, or other materials used to activate non-conductive surfaces, such as palladium. In some embodiments, the mandrel insert 24 may be fabricated from a metallic material (e.g., titanium, nickel, cobalt, or alloys containing combinations of titanium, nickel, or cobalt). The mandrel insert 24 may be a solid structure, or it may include one or more cavities. In some embodiments, the mandrel insert 24 may be a honeycomb-like structure.

Referring to FIGS. 2 and 3, the mandrel insert 24 is positioned within cavity 20 such that the pressure side 52 of the mandrel insert 24 mates with the interior surface 44 of the pressure side wall 16 of the sheath body 12, and such that the suction side 54 of the mandrel insert 24 mates with the interior surface 48 of the suction side wall 18 of the sheath body 12. Referring to FIG. 1, the datum surface 62 mates with the airfoil 26 that is ultimately positioned within the cavity 20, as discussed below. The mandrel insert 24 is secured to the sheath body 12 as a result of the electroforming process discussed below. Referring to FIG. 1, the electroformed sheath 10 is affixed to the airfoil 26 of the fan blade 28 in a manner well known in the art; e.g., using mechanical fasteners, epoxy bonding, etc.

Manufacture

In manufacturing the electroformed sheath 10 of the present invention, the mandrel insert 24 is secured to the mandrel 32, which has an exterior surface that conforms to the airfoil 26 of the fan blade 28, minus the thickness of the mandrel insert 24 and the sheath body 12 to be electroformed on the mandrel 32. The mandrel insert 24 is secured to the mandrel 32 at a leading edge position 70 of the mandrel 32, which position 70 coincides with a leading edge section of the airfoil 26 of the fan blade 28. The mandrel 32 and mandrel insert 24 are placed in an appropriate electroplate bath, and the leading edge 14, pressure and suction side walls 16, 18 and head section 23 form around conductive surfaces of the mandrel 32 and mandrel insert 24 to form the sheath body 12 with the mandrel insert 24. The mandrel insert 24 enhances electroformation of material from the electroplate bath around the leading edge position 70 of the mandrel 32; e.g., the mandrel insert 24 facilitates the electroformation of a sheath body 12 having characteristics (e.g., geometry, length 34, width 34, length-to-width ratio, "sharpness" of the leading edge 14, etc.) that, due to constraints of electroforming techniques, might be difficult or expensive to achieve without the use of the mandrel insert 24.

The mandrel 32 and mandrel insert 24 remain in the electroplate bath for a predetermined time necessary for the sheath body 12 to be electroplated around the mandrel insert 24 and mandrel 32. The mandrel 32 is then removed from the bath, and the sheath body 12 and mandrel insert 24 are mechanically removed from the mandrel 32 in a manner well known in the art. When the sheath body 12 is removed from the mandrel 32, the mandrel insert 24 remains in the sheath body 12, and the sheath cavity 20 is defined within the sheath body 12 by the area previously occupied by the mandrel 32, as shown in FIG. 3. The electroformed sheath 10 is then affixed to the airfoil 26 of the fan blade 28, as shown in FIG. 1, in a manner well known in the art; e.g., using mechanical fasteners, epoxy bonding, etc.

Operation

Referring to FIG. 1, in operation, high-speed rotation of the fan blade 28 will result in contact with foreign objects being limited to contact with the leading edge 14 of the sheath 10. Before any such foreign object could reach and damage the airfoil 26 of the blade 28, it would have to completely penetrate both the head section 23 of the sheath body 12 and the mandrel insert 24. Consequently, the electroformed sheath 10 of the present invention affords substantially enhanced protection for a part such as fan blade 28.

As a result of the various embodiments disclosed herein, the current invention fully addresses the needs in the art for electroformed sheaths having certain characteristics and for methods for protecting airfoils of a gas turbine engine using such electroformed sheaths. While various embodiments of the present invention have been disclosed, it will be apparent to those of ordinary skill in the art that many more embodiments and implementations are possible within the scope of the invention. Accordingly, the present invention is not to be restricted except in light of the attached claims and their equivalents.

What is claimed is:

1. A method for protecting an airfoil of a gas turbine engine, the method comprising the steps of:

securing an electrically conductive mandrel insert to a mandrel, wherein the mandrel insert includes a cross-sectional geometry that is generally wedge-shaped and is defined by a length and a width;

electroplating, in an electroplate bath, a sheath body onto the mandrel and the mandrel insert, the sheath body including a pressure side wall and an opposed suction side wall;

removing the mandrel from the sheath body so that a sheath cavity is defined within the sheath body by the position occupied by the mandrel to form an electroformed sheath that is integral with the mandrel insert; and securing the airfoil within the sheath cavity so that the electroformed sheath and the integral mandrel insert protect the airfoil;

wherein the width of the integral mandrel insert extends in a lateral direction between the pressure side wall and the suction side wall; and wherein a maximum value of the width of the integral mandrel insert is greater than at least one of a maximum value of a thickness of the pressure side wall measured in the lateral direction; or a maximum value of a thickness of the suction side wall measured in the lateral direction.

2. The method of claim 1, wherein the integral mandrel insert is made of a non-metallic composite.

3. The method of claim 2, wherein the integral mandrel insert is a honeycomb-like structure.

4. The method of claim 1, wherein the mandrel insert is integral with the electroformed sheath proximate a leading edge of the electroformed sheath.

* * * * *